US011769958B2

(12) United States Patent
Maeta et al.

(10) Patent No.: US 11,769,958 B2
(45) Date of Patent: Sep. 26, 2023

(54) CONNECTOR FOR CONNECTION TO A SHEET-LIKE ELECTRICALLY CONDUCTIVE MEMBER PROVIDED WITH A PLURALITY OF ELECTRICALLY CONDUCTIVE PORTIONS THAT ARE ARRANGED AT DIFFERENT HEIGHT POSITIONS IN THE THICKNESS DIRECTION OF THE ELECTRICALLY CONDUCTIVE MEMBER

(71) Applicants: J.S.T. Mfg. Co., Ltd., Tokyo (JP); TATSUTA ELECTRIC WIRE & CABLE CO., LTD., Higashiosaka (JP)

(72) Inventors: Yuki Maeta, Osaka (JP); Shouzaburo Koyama, Saka (JP); Tsugumi Takamatsu, Osaka (JP); Takashi Iwamoto, Higashiosaka (JP); Koujirou Ikoma, Higashiosaka (JP); Hiroshi Araki, Higashiosaka (JP)

(73) Assignees: J.S.T. MFG. CO., LTD., Tokyo (JP); TATSUTA ELECTRIC WIRE & CABLE CO., LTD., Higashiosaka (JP)

( * ) Notice: Subject to any disclaimer, the term of this patent is extended or adjusted under 35 U.S.C. 154(b) by 118 days.

(21) Appl. No.: 17/436,463

(22) PCT Filed: Feb. 18, 2020

(86) PCT No.: PCT/JP2020/006334
§ 371 (c)(1),
(2) Date: Sep. 3, 2021

(87) PCT Pub. No.: WO2020/179436
PCT Pub. Date: Sep. 10, 2020

(65) Prior Publication Data

US 2022/0173538 A1 Jun. 2, 2022

(30) Foreign Application Priority Data

Mar. 7, 2019 (JP) ..... 2019-041581

(51) Int. Cl.
*H01R 12/77* (2011.01)
*H01R 12/81* (2011.01)

(52) U.S. Cl.
CPC ..... *H01R 12/778* (2013.01); *H01R 12/81* (2013.01)

(58) Field of Classification Search
CPC ..... H01R 12/778; H01R 12/81
See application file for complete search history.

(56) References Cited

U.S. PATENT DOCUMENTS 6,220,881 B1 4/2001 Murakami
8,088,331 B2 1/2012 Ueda
(Continued)

FOREIGN PATENT DOCUMENTS

JP H03-006555 U 1/1991
JP H04-249082 A 9/1992
(Continued)

OTHER PUBLICATIONS

Japanese Office Action of Japanese Patent Application No. 2021-503524 dated Jan. 17, 2023 (4 sheets, 4 sheets translation, 8 sheets total).

*Primary Examiner* — Ross N Gushi
(74) *Attorney, Agent, or Firm* — Kratz, Quintos & Hanson, LLP

(57) ABSTRACT

The present invention provides a connector that can be easily and properly connected to a sheet-like electrically conductive member that is provided with a plurality of electrically conductive portions arranged at different height positions in the thickness direction. A connector 1 includes a plurality of contacts 2, a body housing 5 that holds the
(Continued)

contacts 2, and a cover housing 7 that is attached to the body housing 5. The body housing 5 has a plurality of holding portions 51 that hold the contacts 2. The holding portions 51 are provided in the body housing 5 so as to hold the contacts 2 at different height positions in the thickness direction of the body housing 5. A plurality of electrically conductive portions 101 come into contact with the contacts 2 in a state where an electrically conductive member 100 is sandwiched between the cover housing 7 and the body housing 5.

5 Claims, 11 Drawing Sheets

(56) References Cited

U.S. PATENT DOCUMENTS

| | | | | |
|---|---|---|---|---|
| 9,166,319 | B2 | 10/2015 | Gingrich | |
| 9,905,948 | B1 * | 2/2018 | Yu | H01R 12/7082 |
| 2007/0275296 | A1 | 11/2007 | Ueda | |
| 2015/0111410 | A1 | 4/2015 | Gingrich | |

FOREIGN PATENT DOCUMENTS

| | | | |
|---|---|---|---|
| JP | H11-288768 | A | 10/1999 |
| JP | 2005-026020 | A | 1/2005 |
| JP | 2015-079757 | A | 4/2015 |
| WO | 2005/083410 | A1 | 9/2005 |

* cited by examiner

CONNECTOR FOR CONNECTION TO A SHEET-LIKE ELECTRICALLY CONDUCTIVE MEMBER PROVIDED WITH A PLURALITY OF ELECTRICALLY CONDUCTIVE PORTIONS THAT ARE ARRANGED AT DIFFERENT HEIGHT POSITIONS IN THE THICKNESS DIRECTION OF THE ELECTRICALLY CONDUCTIVE MEMBER

TECHNICAL FIELD

The present invention relates to a connector for connection to an electrically conductive member that is a sheet-like electrically conductive member and is provided with a plurality of electrically conductive portions that are arranged at different height positions in the thickness direction of the electrically conductive member.

BACKGROUND ART

Conventionally, connectors have been used to connect a sheet-like electrically conductive member and a wire. The connector disclosed in Patent Document 1 is known as such a connector.

The connector disclosed in Patent Document 1 is configured as a connector for connection to a plurality of wires and for connection to a sheet-like electrically conductive member provided as a flexible circuit board. The connector of Patent Document 1 has a plurality of contacts and a housing that holds the contacts. The contacts are held in the housing in a state of being connected to the end portions of corresponding wires, and thus the connector is connected to the wires.

Also, the connector of Patent Document 1 is provided with a clip that is coupled to the housing and can be moved between an open position and a closed position. The connector is configured to receive a portion of the sheet-like electrically conductive member in an intermediate space formed between the housing and the clip when the clip is at the open position. This connector is also configured to sandwich and trap a portion of the sheet-like electrically conductive member when the clip is at the closed position so as to connect the contacts to contact pads provided on the electrically conductive member.

CITATION LIST

Patent Documents

Patent Document 1: JP 2015-79757A

SUMMARY OF INVENTION

Technical Problem

According to the connector of Patent Document 1, a wire or the like can be connected to a sheet-like electrically conductive member. Here, since the sheet-like electrically conductive member is formed in the shape of a sheet, it is configured as an electrically conductive member that has a layer structure including insulating portion layers and electrically conductive portion layers. For this reason, the sheet-like electrically conductive member can be configured such that the electrically conductive portion layers are arranged at different height positions in the thickness direction. Accordingly, even if there is a demand to realize a configuration in which an electrically conductive member is provided with a plurality of electrically conductive portions arranged at different height positions in the thickness direction, that demand can be easily met using the sheet-like electrically conductive member.

However, according to the connector of Patent Document 1, a plurality of contacts are held in the housing at the same height position in the thickness direction of the housing. For this reason, when the connector of Patent Document 1 is connected to a sheet-like electrically conductive member that is provided with a plurality of electrically conductive portions arranged at different height positions in the thickness direction, it is difficult to properly connect the contacts of the connector to the electrically conductive portions of the sheet-like electrically conductive member. Therefore, it is difficult for the connector of Patent Document 1 to be configured for proper connection to a sheet-like electrically conductive member that is provided with a plurality of electrically conductive portions arranged at different height positions in the thickness direction.

In view of the above circumstances, an object of the present invention is to provide a connector that can be easily and properly connected to a sheet-like electrically conductive member that is provided with a plurality of electrically conductive portions arranged at different height positions in the thickness direction.

Solution to Problem (1) A connector according to an aspect of the present invention for realizing the aforementioned object is related to a connector for connection to an electrically conductive member that is a sheet-like electrically conductive member and is provided with a plurality of electrically conductive portions that are arranged at different height positions in the thickness direction of the electrically conductive member. The connector according to this aspect of the present invention includes: a plurality of contacts; a body housing configured to hold the plurality of contacts; and a cover housing configured to be engaged with and attached to the body housing in a state where a portion of the electrically conductive member is sandwiched between the cover housing and the body housing, wherein the body housing includes a plurality of holding portions configured to respectively hold the plurality of contacts, the plurality of holding portions are provided in the body housing so as to respectively hold the plurality of contacts at different height positions in a thickness direction of the body housing, and the plurality of electrically conductive portions and the plurality of contacts are respectively in contact with each other in the state where the portion of the electrically conductive member is sandwiched between the cover housing and the body housing.

According to this configuration, the plurality of contacts for connection to wires or the like are held by the plurality of holding portions of the body housing, and the holding portions hold the contacts at different height positions in the thickness direction of the body housing. The cover housing is engaged with and attached to the body housing in the state where the portion of the electrically conductive member is sandwiched between the body housing and the cover housing, and the electrically conductive portions and the contacts come into contact with each other. For this reason, the electrically conductive portions arranged at different height positions in the thickness direction of the sheet-like electrically conductive member and the contacts held at different height positions in the thickness direction of the body housing are easily and properly connected at corresponding height positions.

Therefore, according to the above configuration, it is possible to provide the connector that can be easily and properly connected to the sheet-like electrically conductive member that is provided with the plurality of electrically conductive portions that are arranged at different height positions in the thickness direction.

(2) A configuration is possible in which the connector further includes an intermediate housing that is configured to be attached to the body housing in a state of covering a portion of each of the plurality of contacts held in the body housing, and is provided with a plurality of openings for allowing the plurality of contacts to respectively come into contact with the plurality of electrically conductive portions.

According to this configuration, the intermediate housing is attached to the body housing in a state of covering a portion of each of the contacts held in the body housing, and therefore the contacts can be firmly held in a more stable state. Also, the intermediate housing is provided with the plurality of openings, and therefore the contacts and the electrically conductive portions can be easily brought into contact with each other with a simple structure.

(3) A configuration is possible in which the intermediate housing is provided with a step portion formed in a stepped shape so as to be recessed on one surface side and raised on another surface side in a thickness direction of the intermediate housing, an opening among the plurality of openings is provided in the step portion, and the step portion is provided at a location corresponding to any one of the plurality of contacts held in the body housing in a state where the intermediate housing is attached to the body housing.

According to this configuration, the intermediate housing is provided with the step portion at a position corresponding to one of the contacts, the step portion being recessed on one surface side in the thickness direction and raised on the other surface side and being provided with one of the openings. For this reason, the intermediate housing has a structure for more tightly covering portions of the contacts in correspondence with the respective height positions of the contacts that are held at different height positions in the thickness direction in the body housing, and this intermediate housing can be easily realized with a simple structure. Also, the intermediate housing is provided with the raised portion at a position corresponding to one of the contacts, and therefore a longer insulation distance can be ensured between the contacts, and higher connection stability can be obtained due to ensuring the insulation distance.

(4) A configuration is possible in which the cover housing is configured so as to be rotatably coupled to the intermediate housing, and a position of the cover housing is locked relative to the body housing due to the cover housing engaging with the body housing in the state where the portion of the electrically conductive member is sandwiched by the cover housing together with the body housing and the intermediate housing.

According to this configuration, the cover housing, which is rotatably coupled to the intermediate housing, sandwiches the portion of the electrically conductive member together with the body housing and the intermediate housing. In other words, the cover housing rotatably coupled to the intermediate housing sandwiches the portion of the electrically conductive member with the body housing via the intermediate housing. Also, the cover housing is locked by being engaged with the body housing in the state where the portion of the electrically conductive member is sandwiched by the cover housing together with the body housing and the intermediate housing. For this reason, in the operation of connecting the connector and the sheet-like electrically conductive member, the operator can easily connect the connector and the electrically conductive member by merely rotating the cover housing in the state where the portion of the electrically conductive member is arranged on the body housing and the intermediate housing. Also, because the cover housing that is rotatably coupled to the intermediate housing is engaged with and locked to the body housing, the electrically conductive member that is sandwiched by the cover housing as well as the body housing and the intermediate housing can be held more firmly and stably. Accordingly, even if the connector is used in an environment that is likely to be subjected to vibration or the like from the outside, it is possible to maintain the state in which the sheet-like electrically conductive member is firmly held by the connector.

(5) A configuration is possible in which the cover housing is configured to be engaged with the body housing in a state where the cover housing is fitted into the body housing inward of the body housing in the width direction.

According to this configuration, the cover housing is engaged with the body housing in a state of being fitted inward thereof in the width direction. For this reason, even if an external object comes into contact with the connector, it is possible to prevent the object from becoming caught on and coming into contact with the cover housing. Accordingly, even if an external force acts on the connector, it is possible to suppress the case where the cover housing is subjected to force in a direction for causing the cover housing to detach from the body housing. Accordingly even if the connector is used in an environment that is likely to be subjected to vibration or the like from the outside, it is possible to further stably maintain the state in which the sheet-like electrically conductive member is firmly held by the connector.

(6) A configuration is possible in which the electrically conductive member is a sheet sensor for liquid leak detection, the electrically conductive member includes a first electrically conductive portion and a second electrically conductive portion that are arranged at different height positions in the thickness direction of the electrically conductive member, as the plurality of electrically conductive portions, the first electrically conductive portion is arranged so as to extend in a layer at a position corresponding to a bottom portion of a recessed region that is a region of the electrically conductive member that is recessed in the thickness direction of the electrically conductive member, the second electrically conductive portion is arranged so as to extend in a layer along a surface of the electrically conductive member in a region surrounding the recessed region, a first contact and a second contact that are held in the body housing at different height positions in the thickness direction of the body housing are provided as the plurality of contacts in the connector, and in the state where the portion of the electrically conductive member is sandwiched between the cover housing and the body housing, the first contact is in contact with the first electrically conductive portion, and the second contact is in contact with the second electrically conductive portion.

According to this configuration, the sheet-like electrically conductive member to which the connector is connected is configured as a sheet sensor for liquid leak detection. In a state where a portion of the sheet sensor is sandwiched between the cover housing and the body housing, the first contact of the connector comes into contact with the first electrically conductive portion that extends at a position corresponding to the bottom portion of the recessed region of the sheet sensor, and the second contact of the connector comes into contact with the second electrically conductive portion that extends on the surface of the sheet sensor. For this reason, the first and second electrically conductive portions that are arranged at different height positions in the thickness direction in the sheet sensor and the first and second contacts that are held at different height positions in the thickness direction in the body housing can be easily and properly connected at corresponding height positions. Therefore, according to the above configuration, it is possible to provide the connector that can be easily and properly connected to the sheet sensor for liquid leak detection that is provided with a plurality of electrically conductive portions arranged at different height positions in the thickness direction.

Advantageous Effects of Invention

According to the present invention, it is possible to provide a connector that can be easily and properly connected to a sheet-like electrically conductive member provided with a plurality of electrically conductive portions arranged at different height positions in the thickness direction.

BRIEF DESCRIPTION OF DRAWINGS

FIG. 4A is a plan view of a portion of the electrically conductive member, and FIG. 4B is a cross-sectional view of a portion of the electrically conductive member at a position indicated by arrow lines C-C in FIG. 4A.

FIG. 7A is a plan view, FIG. 7B is a front view, FIG. 7C is a right side view, and FIG. 7D is a bottom view.

FIG. 8A is a plan view, FIG. 8B is a front view, FIG. 8C is a right side view, and FIG. 8D is a bottom view.

FIG. 9A is a plan view. FIG. 9B is a front view, FIG. 9C is a right side view, and FIG. 9D is a bottom view.

DESCRIPTION OF EMBODIMENTS

Hereinafter, embodiments for carrying out the present invention will be described with reference to the drawings. Note that the present invention can broadly used in various applications as a connector for connection to an electrically conductive member that is a sheet-like electrically conductive member and is provided with a plurality of electrically conductive portions arranged at different height positions in the thickness direction of the electrically conductive member.

Overview of Connector

Figure 1:
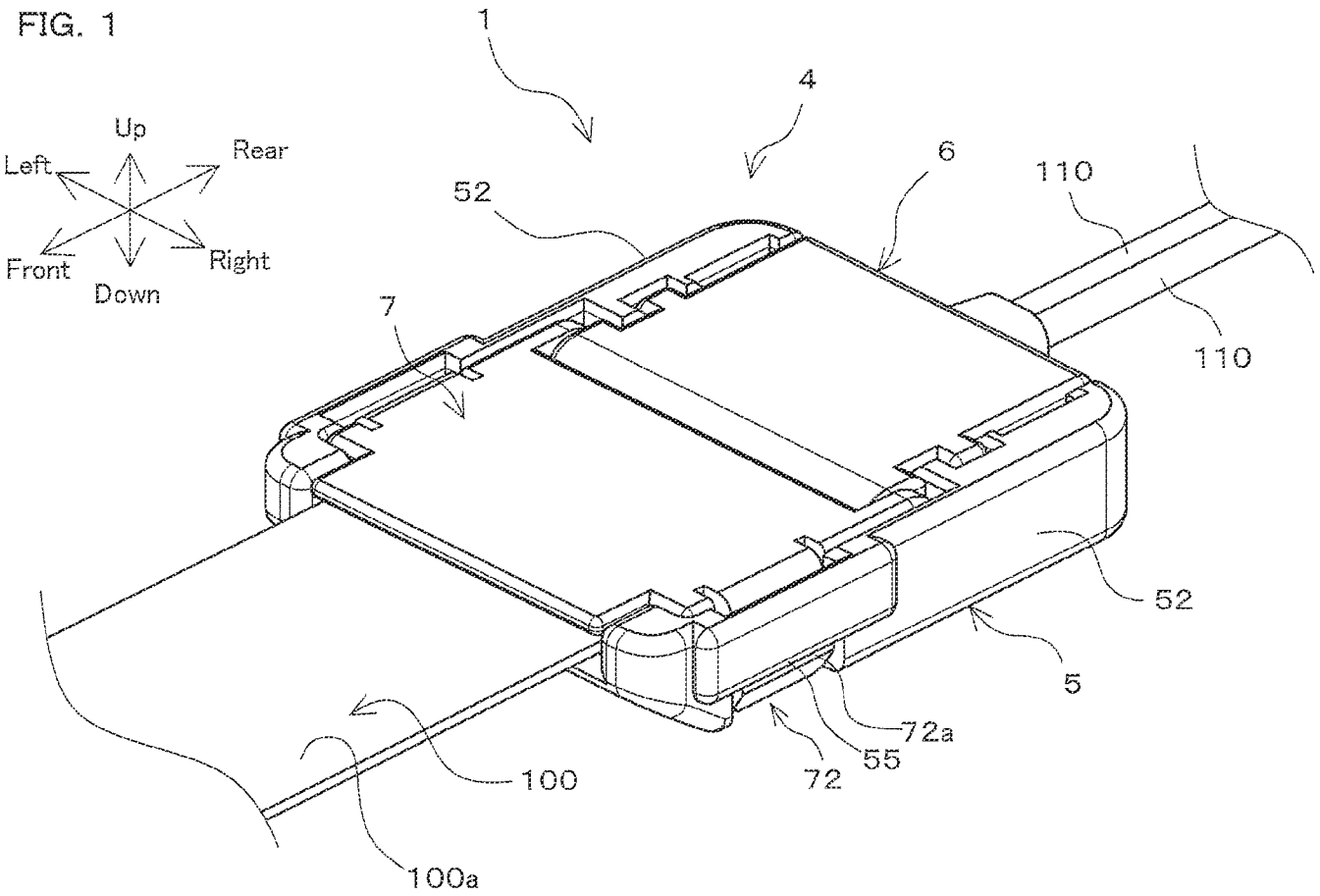
FIG. 1 is a perspective view of a connector according to an embodiment of the present invention, and also shows an electrically conductive member connected to the connector.
Figure 2:
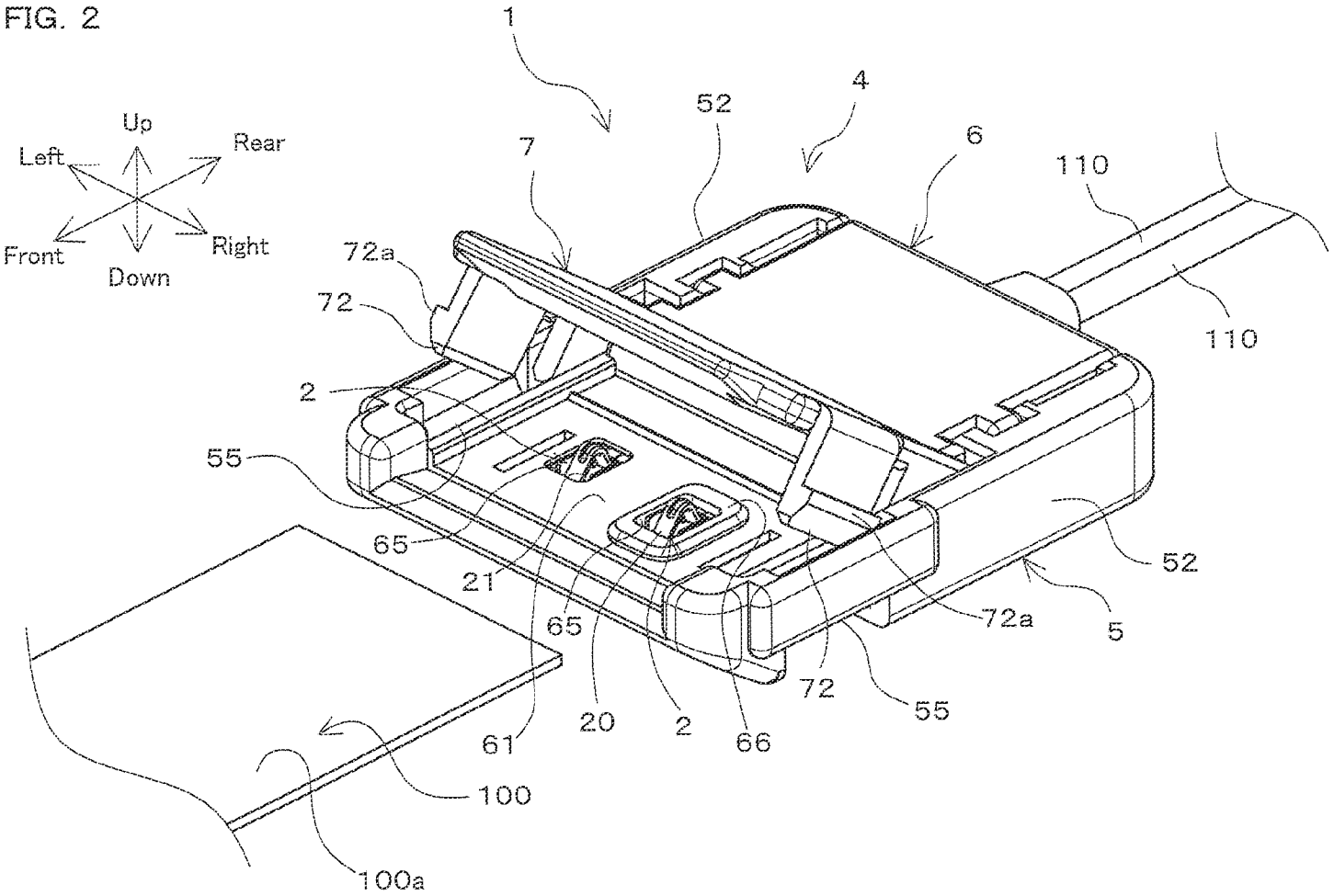
FIG. 2 is a perspective view of the connector and the electrically conductive member, and shows a state in which the connector is not connected to the electrically conductive member.
Figure 3:
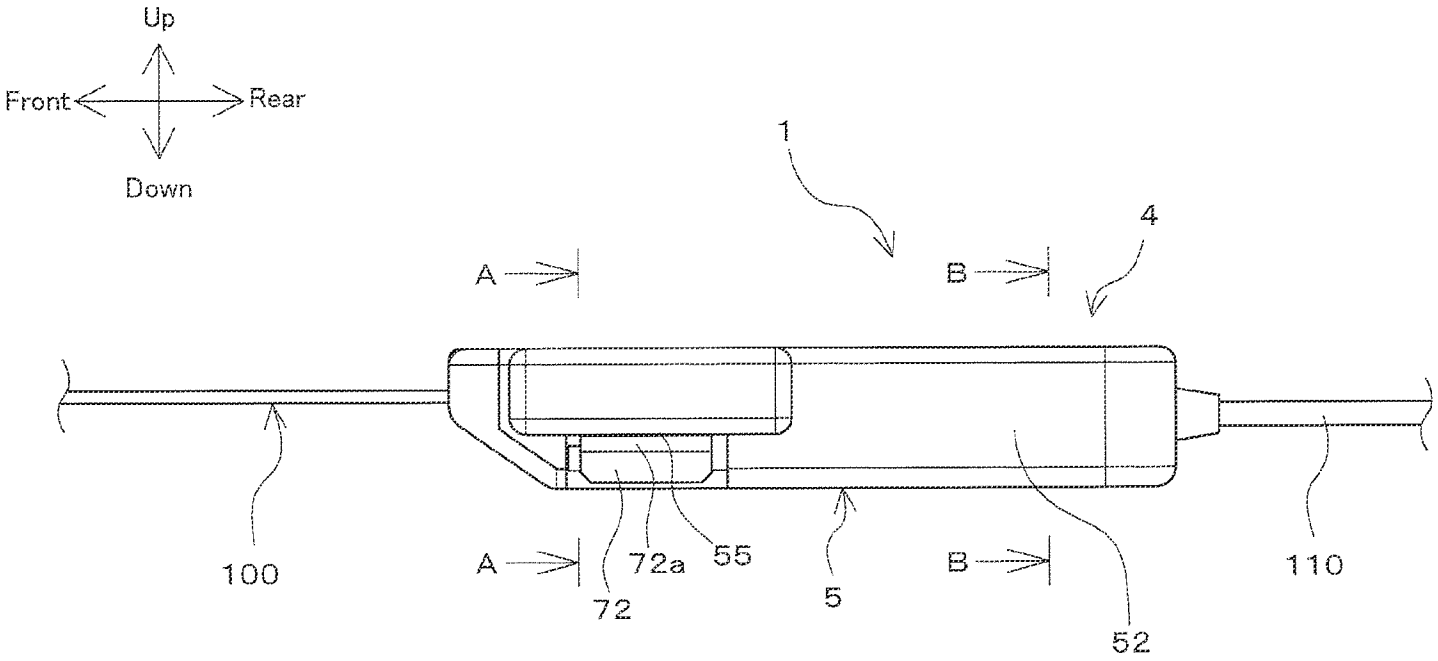
FIG. 3 is a side view of the connector, and also shows the electrically conductive member connected to the connector.

FIG. 1 is a perspective view of a connector 1 according to an embodiment of the present invention, and also shows an electrically conductive member 100 connected to the connector 1. FIG. 2 is a perspective view of the connector 1 and the electrically conductive member 100, and shows a state in which the connector 1 is not connected to the electrically conductive member 100. FIG. 3 is a side view of the connector 1, and also shows the electrically conductive member 100 connected to the connector 1. Note that in FIGS. 1 to 3 and later-described FIGS. 4A to 9D, thin lines for showing the surface shape have been added in the illustrations of the connector 1 and the components thereof.

Also, in FIGS. 1 to 3 and the later-described figures, for convenience in the description, "rightward" refers to the direction indicated by the arrow denoted by "right", and "leftward" refers to the direction indicated by the arrow denoted by "left". Also, "upward" refers to the direction indicated by the arrow denoted by "up", "downward" refers to the direction indicated by the arrow denoted by "down", "forward" refers to the direction indicated by the arrow denoted by "front", and "rearward" refers to the direction indicated by the arrow denoted by "rear". Note that the up-down direction will also be referred to as the thickness direction or the height direction, and the left-right direction will also be referred to as the width direction.

The connector 1 includes a plurality of contacts 2 and a housing 4. The housing 4 includes a body housing 5, an intermediate housing 6, and a cover housing 7. The connector 1 is configured as a connector that mechanically and electrically connects the sheet-like electrically conductive member 100 and a plurality of wires 110. Note that the present embodiment illustrates an aspect in which the connector 1 connects the sheet-like electrically conductive member 100 and a pair of wires 110. For this reason, the present embodiment illustrates an aspect in which the connector 1 includes a pair of contacts 2 as the plurality of contacts 2.

In the connector 1, the contacts 2 are held in the housing 4, and end portions of the wires 110 are respectively connected to the contacts 2. Also, in the electrically conductive member 100, a plurality of electrically conductive portions are arranged at different height positions in the thickness direction. In the housing 4, the contacts 2 connected to the wires 110 respectively come into contact with electrically conductive portions of the electrically conductive member 100, and thus the wires 110 and the electrically conductive member 100 are electrically connected. Note that in the following description of the connector 1, first, the electrically conductive member 100 to which the connector 1 is connected will be described, and then details of the configuration of the connector 1 will be described.

Electrically Conductive Member

Figure 4A:
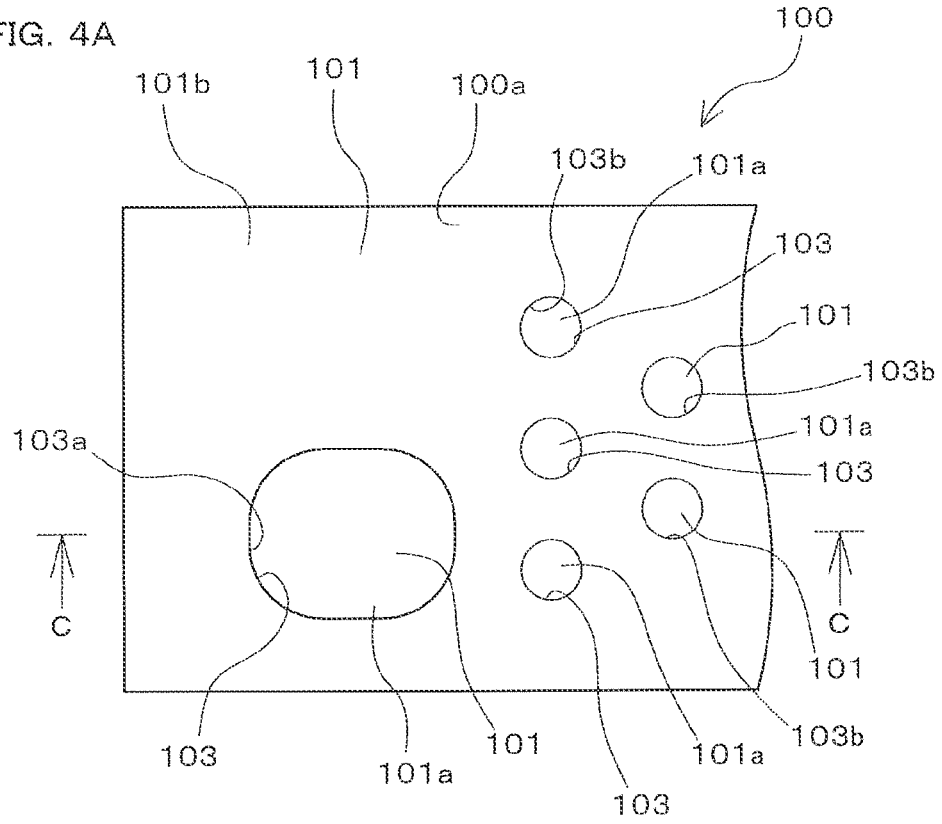
FIGS. 4A and 4B are diagrams schematically showing the electrically conductive member that is to be connected to the connector, where
Figure 4B:
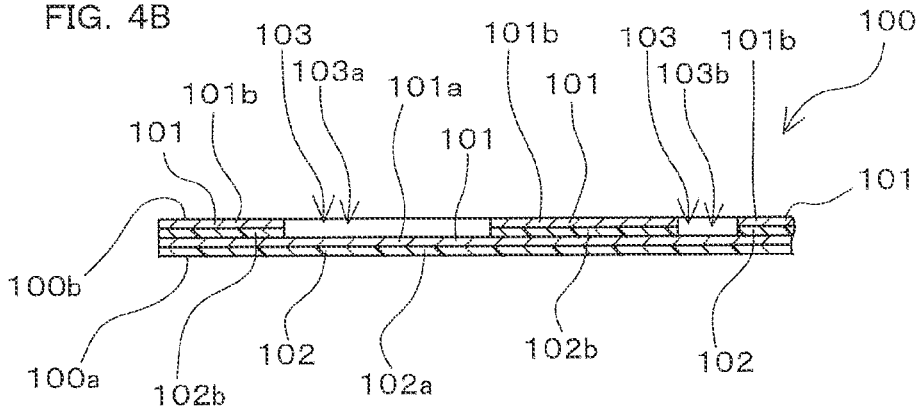

FIGS. 4A and 4B are diagrams schematically showing the electrically conductive member 100 that is to be connected to the connector 1, where FIG. 4A is a plan view of a portion of the electrically conductive member 100, and FIG. 4B is a cross-sectional view of a portion of the electrically conductive member 100 at a position indicated by arrow lines C-C in FIG. 4A. The electrically conductive member 100 is configured as a sheet-like electrically conductive member that is flexible and extends flatly. Note that FIGS. 4A and 4B illustrate an aspect in which the electrically conductive member 100 is configured to extend in a strip shape.

The electrically conductive member 100 is provided with a plurality of electrically conductive portions 101 that are arranged at different height positions in the thickness direction. Also, the electrically conductive member 100 is provided with a plurality of insulating portions 102 along with the electrically conductive portions 101. In the electrically conductive member 100, the electrically conductive portions 101 and the insulating portions 102 are arranged in layers.

In the electrically conductive member 100, the electrically conductive portions 101 are arranged in a state of being insulated by the insulating portions 102. However, each of the electrically conductive portions 101 has a portion that is exposed to the outside. The electrically conductive member 100 is configured such that upon coming into contact with a conductive liquid such as water or being immersed in such a liquid, liquid paths are formed between the electrically conductive portions 101, and electrical conductivity is achieved between the electrically conductive portions 101. Also, the electrically conductive member 100 is configured such that the electrically conductive portions 101 are respectively in contact with and electrically connected to the contacts 2 of the connector 1. According to these configurations, the sheet-like electrically conductive member 100 is configured as a liquid leak detection sheet sensor 100 that can detect the leakage of a conductive liquid such as water.

The structure of the electrically conductive member 100 will be described below in more detail. In the present embodiment, as shown in FIG. 4B, the electrically conductive member 100 has a first electrically conductive portion 101*a* and a second electrically conductive portion 101*b* as the plurality of electrically conductive portions 101. Also, the electrically conductive member 100 has a first insulating portion 102*a* and a second insulating portion 102*b* as the plurality of insulating portions 102.

The first electrically conductive portion 101*a* and the second electrically conductive portion 101*b* are arranged at different height positions in the thickness direction of the electrically conductive member 100. The first insulating portion 102*a* and the second insulating portion 102*b* are also arranged at different height positions in the thickness direction of the electrically conductive member 100. The first insulating portion 102*a*, the first electrically conductive portion 101*a*, the second insulating portion 102*b*, and the second electrically conductive portion 101*b* are stacked in this order from one surface 100*a* side to another surface 100*b* side of the electrically conductive member 100 in the thickness direction. Therefore, the first electrically conductive portion 101*a* and the second electrically conductive portion 101*b* are arranged in a state of being insulated from each other by the second insulating portion 102*b*. The first insulating portion 102*a* is arranged on the one surface 100*a* side of the electrically conductive member 100, and the second electrically conductive portion 101*b* is arranged on the other surface 100*b* side of the electrically conductive member 100.

Also, the electrically conductive member 100 is provided with a plurality of recessed regions 103, which are regions that are recessed in the thickness direction of the electrically conductive member 100. Each of the recessed regions 103 is provided as a recessed region that is open on the surface 100*b* side of the electrically conductive member 100. The first electrically conductive portion 101*a* is arranged in the electrically conductive member 100 so as to extend in a layer at positions corresponding to the bottom portions of the recessed regions 103. Note that the bottom portions of the recessed regions 103 are the regions of the recessed regions 103 on the side opposite to the surface 100*b* side, and are the regions on the side opposite to the open side at the surface 100*b* in the thickness direction of the electrically conductive member 100. The first electrically conductive portion 101*a* extends in a layer at positions that correspond to the bottom portions of the recessed regions 103, and is exposed to the outside in the spaces formed by the recessed regions 103 at positions that correspond to the recessed regions 103 on the extending layer surface.

Also, the second electrically conductive portion 101*b* is arranged so as to extend in a layer along the surface 100*b* of the electrically conductive member 100 in the region surrounding the recessed regions 103. For this reason, the second electrically conductive portion 101*b* is exposed to the outside at the surface 100*b* of the electrically conductive member 100. The second electrically conductive portion 101*b* is provided with through holes at positions corresponding to the recessed regions 103 such that the recessed regions 103 are open to the outside. In other words, the second electrically conductive portion 101*b* is provided so as to extend along the surface 100*b* of the electrically conductive member 100 in a state where holes are formed at positions corresponding to the recessed regions 103.

Also, the second insulating portion 102*b* is arranged so as to extend in a layer between the first electrically conductive portion 101*a* and the second electrically conductive portion 101*b*. The second insulating portion 102*b* is provided so as to extend in a layer between the first electrically conductive portion 101*a* and the second electrically conductive portion 101*b* in a state where holes are formed at positions corresponding to the recessed regions 103. For this reason, in the region other than the regions corresponding to the recessed regions 103, the first electrically conductive portion 101*a* and the second electrically conductive portion 101*b* are insulated by the second insulating portion 102*b* in the thickness direction of the electrically conductive member 100.

Note that the electrically conductive member 100 is provided with, as the recessed regions 103, a first recessed region 103*a* for bringing the first electrically conductive portion 101*a* into contact with one of the contacts 2 of the connector 1, and second recessed regions 103*b* for liquid leak detection. The first recessed region 103*a* is arranged at a position near an end portion of the electrically conductive member 100, and is provided in the electrically conductive member 100 at a position capable of coming into contact with the contact 2 when the electrically conductive member 100 is connected to the connector 1. The second recessed regions 103*b* are arranged so as to be dispersed on the surface 100*b* of the electrically conductive member 100.

The electrically conductive member 100 provided as the sheet sensor 100 for liquid leak detection is connected to the connector 1, and is disposed in various areas where there is a requirement to detect the presence or absence of the leakage of a conductive liquid such as water. Also, the electrically conductive member 100 is connected to a liquid leak detector (not shown) via the connector 1 and the wires 110 (the pair of wires 110 in the present embodiment). The liquid leak detector is connected to the end portions of the pair of wires 110 on the side opposite to the connector 1.

Also, the connector 1 is connected to the wires 110 at the contacts 2. When the electrically conductive member 100 is connected to the connector 1, the pair of contacts 2 are respectively in contact with the first electrically conductive portion 101*a* and the second electrically conductive portion 101*b*. Specifically, one of the pair of contacts 2 is in contact with the first electrically conductive portion 101*a* that is exposed to the outside in the first recessed region 103*a* of the electrically conductive member 100. The other one of the pair of contacts 2 is in contact with the second electrically conductive portion 101*b* that is exposed to the outside on the surface 100*b* of the electrically conductive member 100.

In a state where no liquid has leaked in the area where the electrically conductive member 100 is arranged, the first electrically conductive portion 101*a* and the second electrically conductive portion 101*b* of the electrically conductive member 100 are insulated from each other, and the pair of wires 110 are not in electrical conduction with each other. However, if a liquid has leaked in the area where the electrically conductive member 100 is arranged, the liquid comes into contact with the electrically conductive member 100, or the electrically conductive member 100 is immersed in the liquid. Accordingly, the liquid infiltrates into the second recessed regions 103*b* of the electrically conductive member 100, liquid paths are formed between the first electrically conductive portion 101*a* and the second electrically conductive portion 101*b*, and the first electrically conductive portion 101*a* and the second electrically conductive portion 101*b* come into electrical conduction with each other.

Also, out of the two contacts 2 of the connector 1, the one contact 2 is in contact with the first electrically conductive portion 101*a*, and the other contact 2 is in contact with the second electrically conductive portion 101*b*. The pair of contacts 2 are respectively connected to the pair of wires 110. For this reason, if a liquid leaks, the liquid infiltrates into the second recessed regions 103*b*, the first electrically conductive portion 101*a* and the second electrically conductive portion 101*b* come into electrical conduction with each other, and the pair of wires 110 come into electrical conduction with each other. Also, the liquid leak detector is configured to apply a voltage between the pair of wires 110 and detect the conductive state when the pair of wires 110 come into electrical conduction and a current greater than or equal to a predetermined threshold value flows therebetween. The liquid leak detector is further configured to detect the occurrence of a liquid leak by detecting the conductive state between the pair of wires 110, and generate an alarm signal or the like.

Contacts

Figure 5:
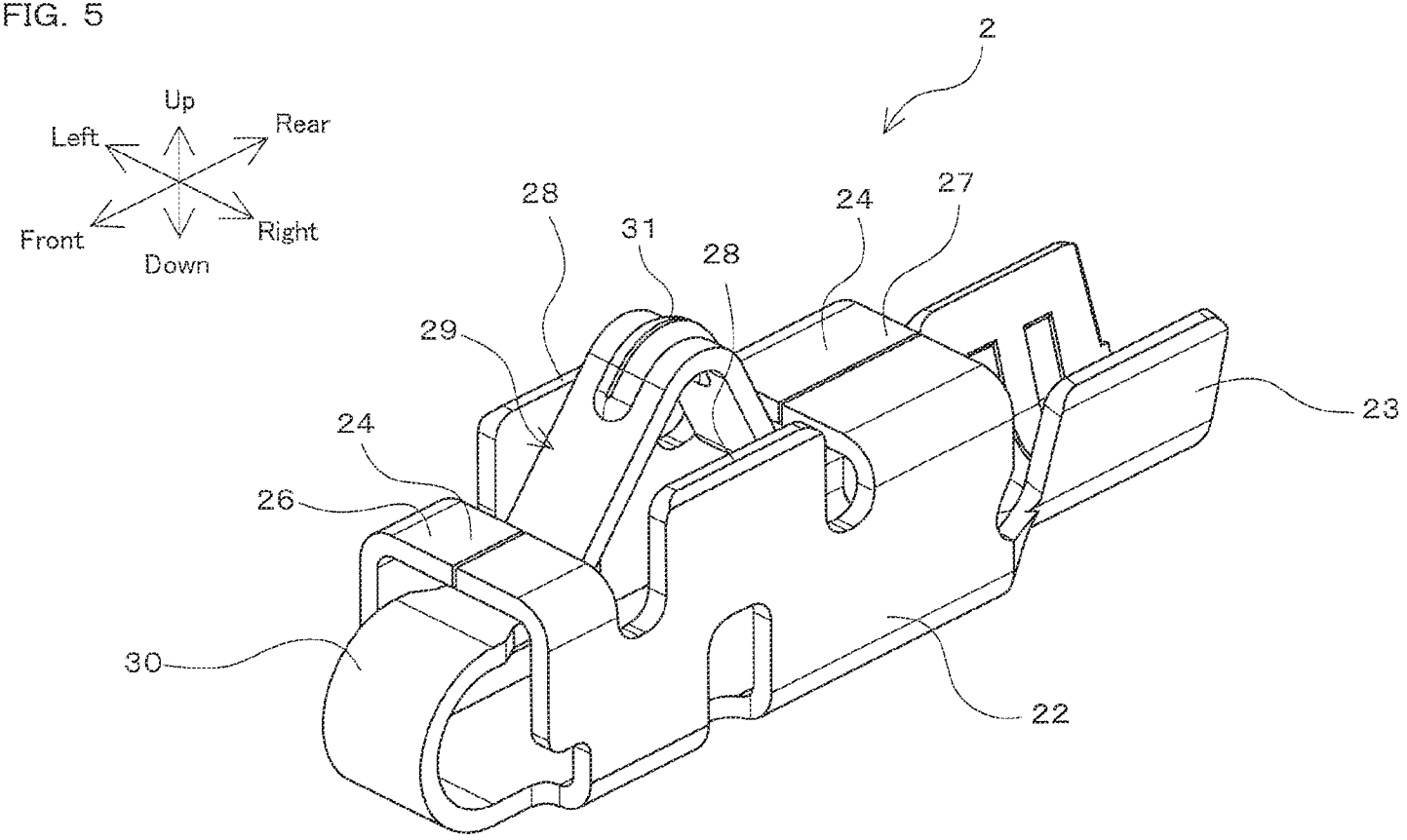
FIG. 5 is an enlarged perspective view of a contact of the connector.

FIG. 5 is an enlarged perspective view of one of the contacts 2 of the connector 1. The contact 2 shown in FIGS. 2 and 5 is formed as a single body made of a conductive metal material. The contact 2 is configured to be connected to a wire 110 by one end portion being crimped to the wire 110, and to be electrically connected to the electrically conductive member 100 by coming into contact with the electrically conductive member 100.

The connector 1 of the present embodiment is provided with a first contact 20 and a second contact 21 as the pair of contacts 2 that constitute the plurality of contacts 2. The first contact 20 and the second contact 21 are provided as contacts 2 that have the same shape, and are arranged at positions separated from each other inside the housing 4. Note that because the first contact 20 and the second contact 21 in the present embodiment have the same shape, the shape of the contact 2 described below applies to the shape of both the first contact 20 and the second contact 21.

The contact 2 has a contact body portion 22, a crimp portion 23, an abutting portion 24, and a spring contact 29.

The contact body portion 22 is substantially shaped as a tube that is elongated in the front-rear direction. The lower surface of the contact body portion 22 is disposed on the upper surface portion of the later-described body housing 5 of the housing 4. The crimp portion 23 is integrally formed on the rear side of the contact body portion 22. The contact 2 is connected to the wire 110 by the wire 110 being crimped in and fixed to the crimp portion 23. Note that the insulating coating on the surface of the end portion of the wire 110 for connection to the contact 2 is partially peeled off to expose the electrically conductive portion before the wire 110 is crimped by the crimp portion 23 of the contact 2 and connected to the contact 2.

As shown in FIG. 5, the abutting portion 24 has a front abutting face 26, a rear abutting face 27, and a pair of projecting pieces 28. The front abutting face 26 and the rear abutting face 27 are configured as portions that come into contact with an inner lid portion 61 of the later-described intermediate housing 6 of the housing 4. The front abutting face 26 is formed so as to be flat and is configured to support the inner lid portion 61. Similarly to the front abutting face 26, the rear abutting face 27 is also formed so as to be flat and is configured to support the lower surface of the inner lid portion 61.

The pair of projecting pieces 28 are arranged at intermediate positions between the front abutting face 26 and the rear abutting face 27, and extend from the contact body portion 22 to a height position that is higher than the front abutting face 26 and the rear abutting face 27. The pair of projecting pieces 28 are respectively arranged on the left and right sides of a contact portion 31 of the later-described spring contact 29, and are shaped as walls that extend in the front-rear direction on the two sides of the contact portion 31. Accordingly, the pair of projecting pieces 28 are configured to protect the contact portions 31 of the spring contact 29 from the outside on the two sides thereof.

The spring contact 29 is provided as a portion that is electrically connected to the electrically conductive member 100 by coming into contact with the electrically conductive portion 101 of the electrically conductive member 100. The spring contact 29 is formed due to a flat plate-shaped portion that extends from the leading end side of the contact body portion 22 being bent a plurality of times toward the crimp portion 23.

The spring contact 29 has a spring portion 30 and a contact portion 31. The spring portion 30 is formed so as to extend in a semicircular arc shape from the leading end portion of the contact body portion 22, and is provided as a portion that elastically deforms and generates contact pressure when the spring contact 29 comes into contact with the electrically conductive member 100. The contact portion 31 is provided as a portion that is electrically connected to the electrically conductive portion 101 of the electrically conductive member 100 by coming into contact with the electrically conductive portion 101. The contact portion 31 is formed so as to bend from the spring portion 30 and extend in a cantilever shape, and is bent so as to form two sides of a substantially triangular shape on the upper side of the contact body portion 22. The contact portion 31 is provided such that the portion on the apex side that is bent so as to form two sides of a substantially triangular shape protrudes outward from the interior of the contact body portion 22. The contact portion 31 is configured such that the apex portion bent so as to form two sides of a substantially triangular shape comes into contact with the electrically conductive portion 101 of the electrically conductive member 100.

The pair of contacts 2 are held in the later-described body housing 5 of the housing 4. The contacts 2 are configured to come into contact with the electrically conductive portion 101 of the electrically conductive member 100 in the state where the portion of the electrically conductive member 100 is sandwiched between the later-described cover housing 7 and the body housing 5 of the housing 4. Out of the two contacts 2, the one first contact 20 is held by the body housing 5 so as to come into contact with the first electrically conductive portion 101*a*. Out of the two contacts 2, the other second contact 21 is held by the body housing 5 so as to come into contact with the second electrically conductive portion 101*b*. Note that in the later-described body housing 5 of the housing 4, the first contact 20 and the second contact 21 are held at different height positions in the thickness direction of the body housing 5. Accordingly, the first contact 20 and the second contact 21 are arranged at positions that are shifted from each other in the up-down direction in the housing 4 (i.e., in the thickness direction of the body housing 5) in correspondence with the height positions of the first electrically conductive portion 101*a* and the second electrically conductive portion 101*b* of the electrically conductive member 100 that are the connection partners.

Housing

Figure 6:
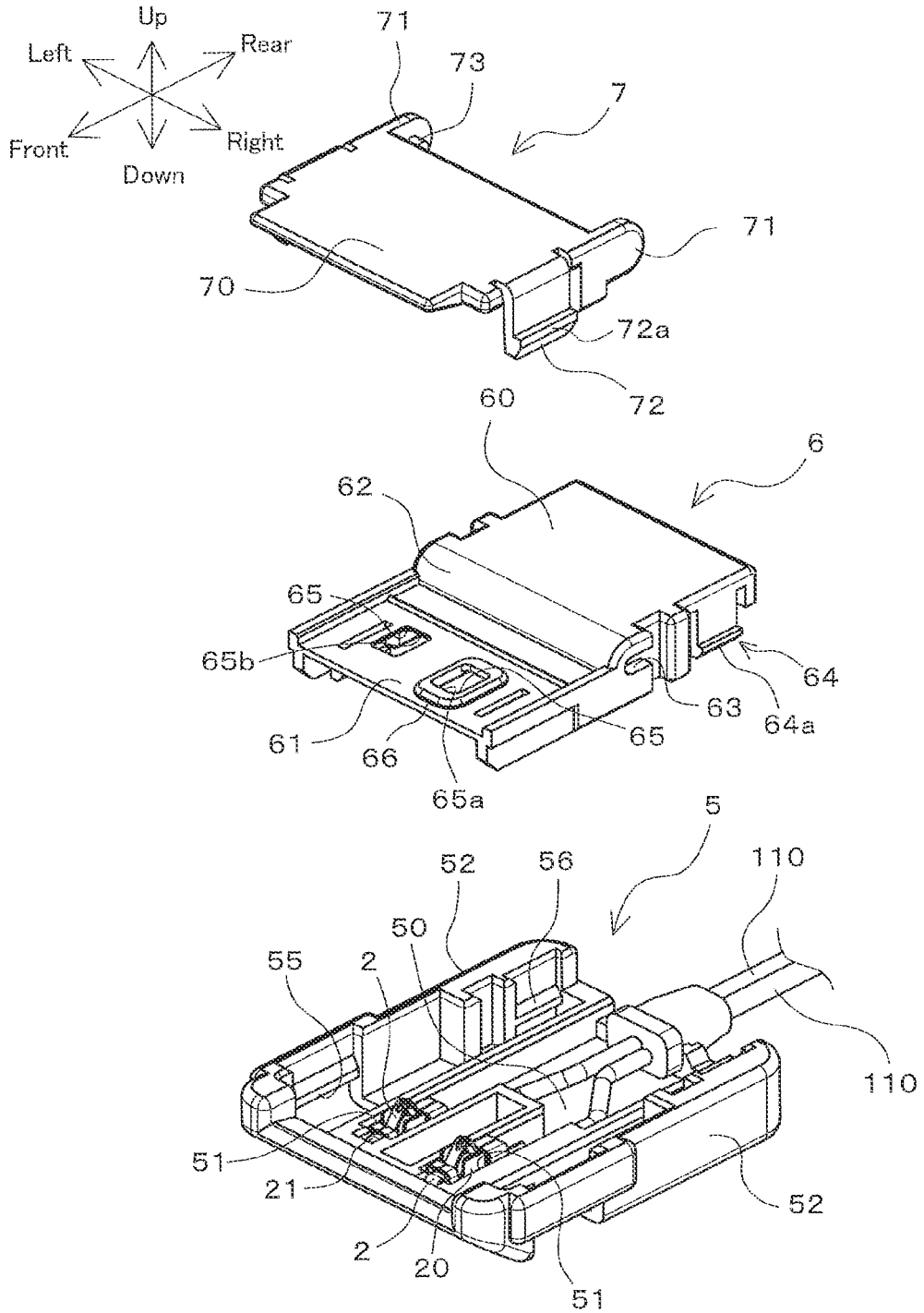
FIG. 6 is an exploded perspective view of the connector.

FIG. 6 is an exploded perspective view of the connector 1. As shown in FIGS. 1 to 3 and FIG. 6, the housing 4 includes the body housing 5, the intermediate housing 6, and the cover housing 7. Note that FIG. 6 illustrates a state in which the body housing 5 holds the contacts 2 that are connected to the wires 110. The body housing 5, the intermediate housing 6, and the cover housing 7 are all made of an insulating resin material.

Figure 7A:
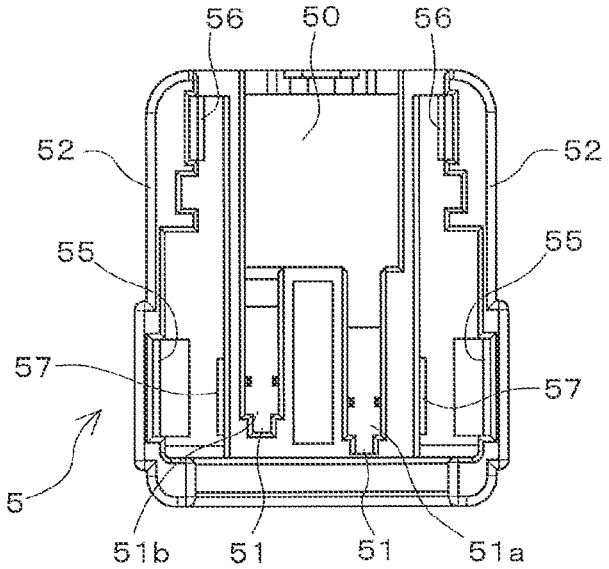
FIGS. 7A to 7D are diagrams showing a body housing of the connector, where
Figure 7B:
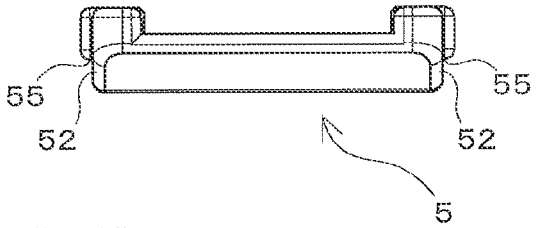
Figure 7C:
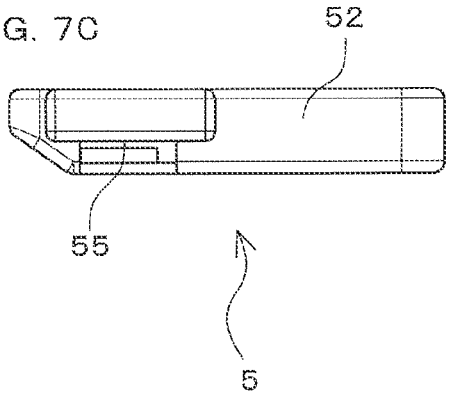
Figure 7D:
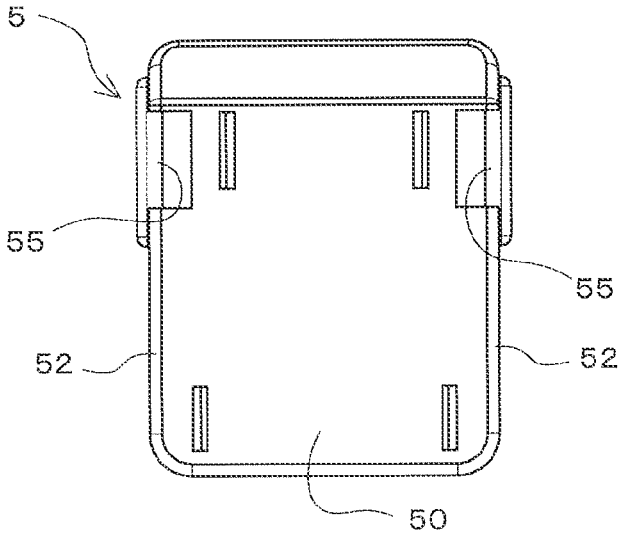
Figure 8A:
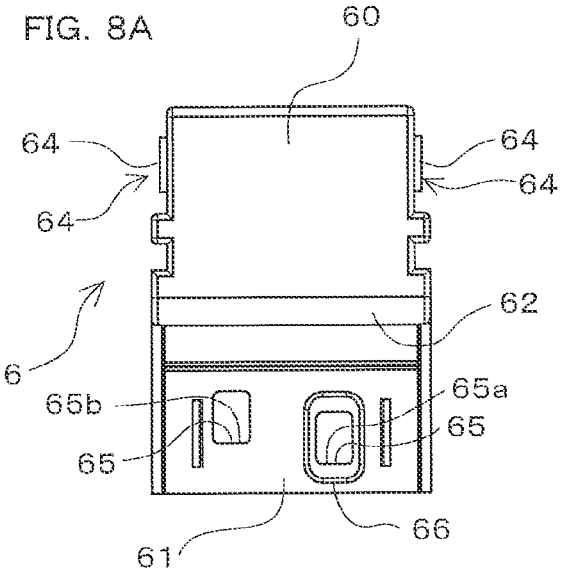
FIGS. 8A to 8D show an intermediate housing of the connector, where
Figure 8B:
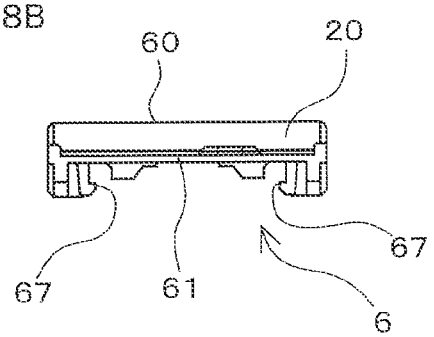
Figure 8C:
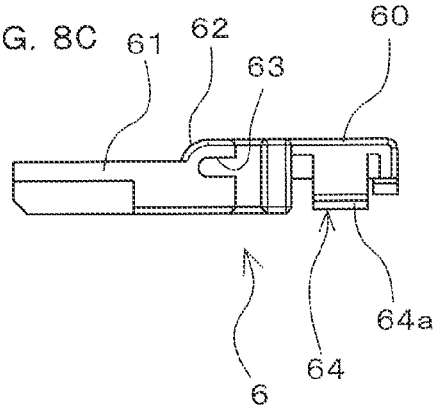
Figure 8D:
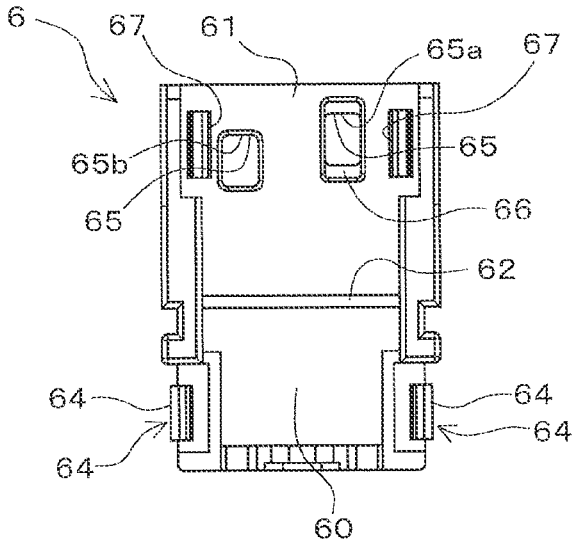
Figure 9A:
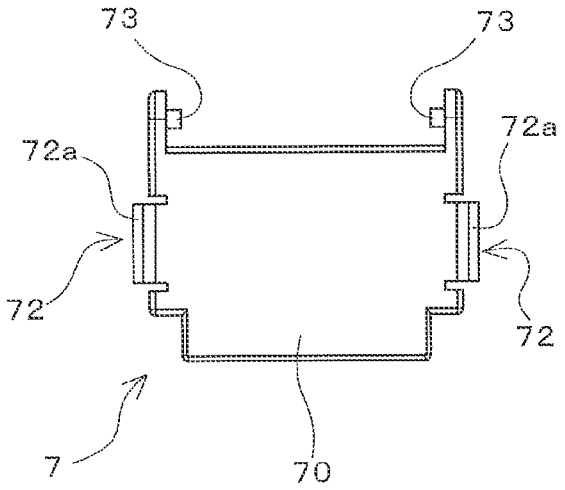
FIGS. 9A to 9D are diagrams showing a cover housing of the connector, where
Figure 9B:
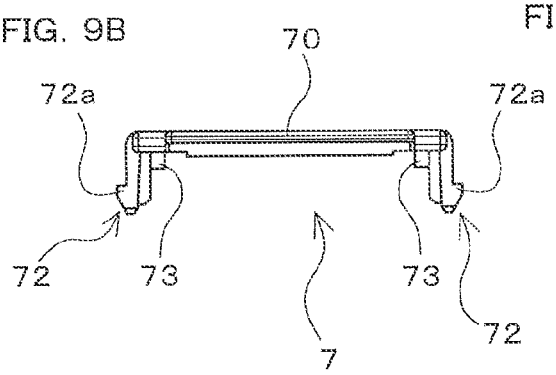
Figure 9C:
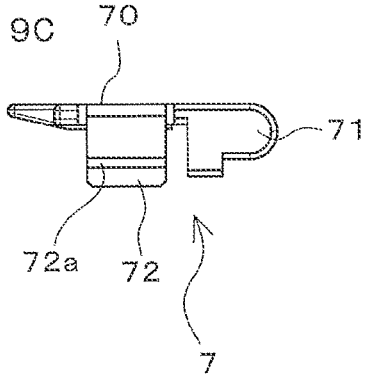
Figure 9D:
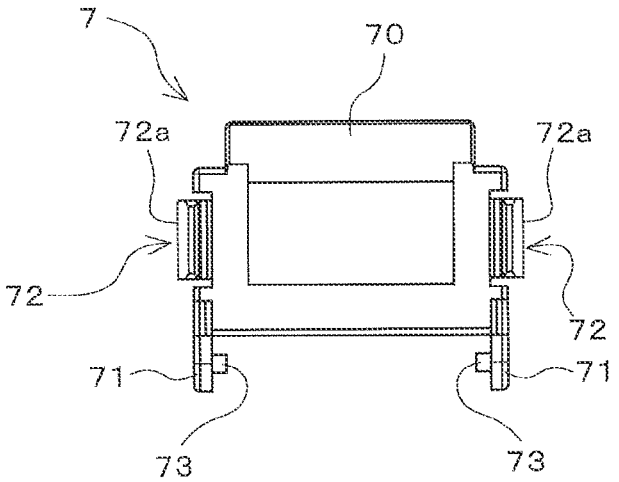
Figure 10:
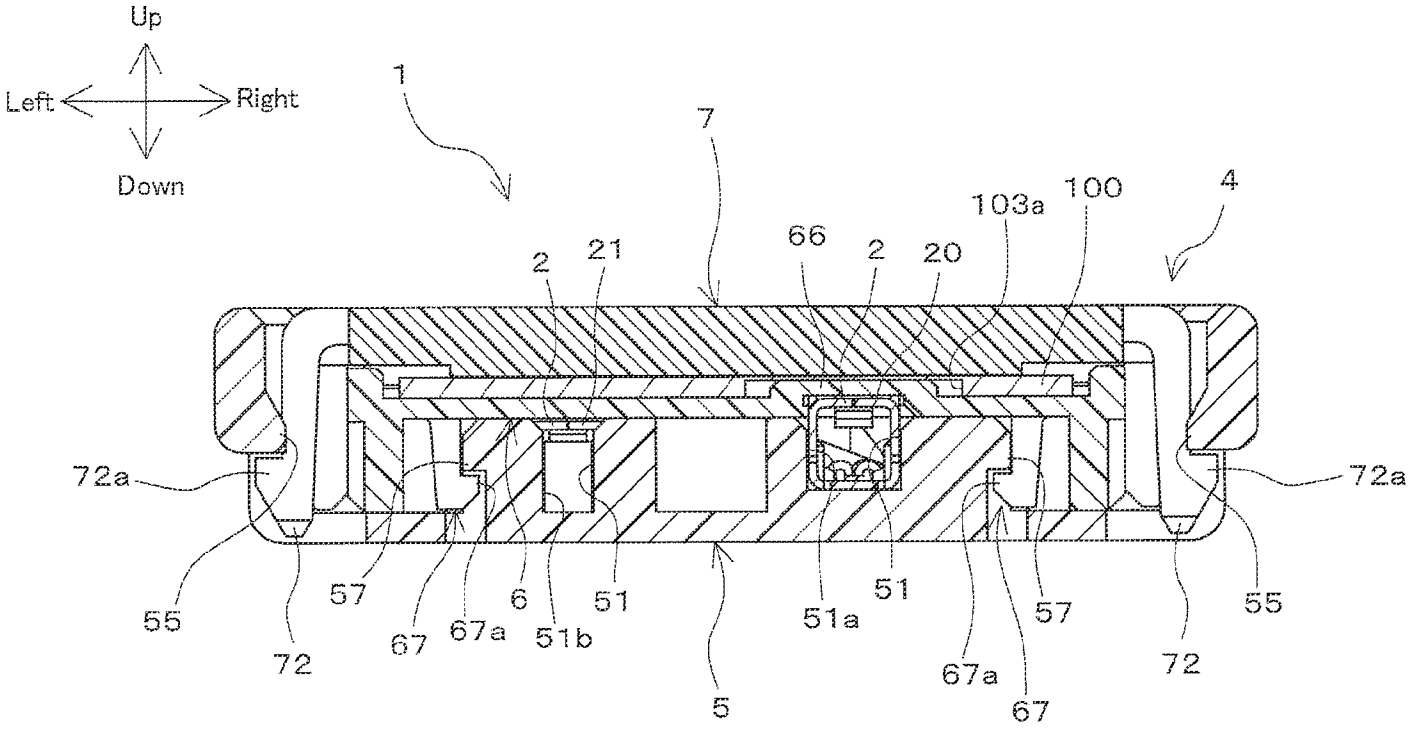
FIG. 10 is a cross-sectional view of the connector, and shows a cross-section at a position indicated by arrow lines A-A of FIG. 3.
Figure 11:
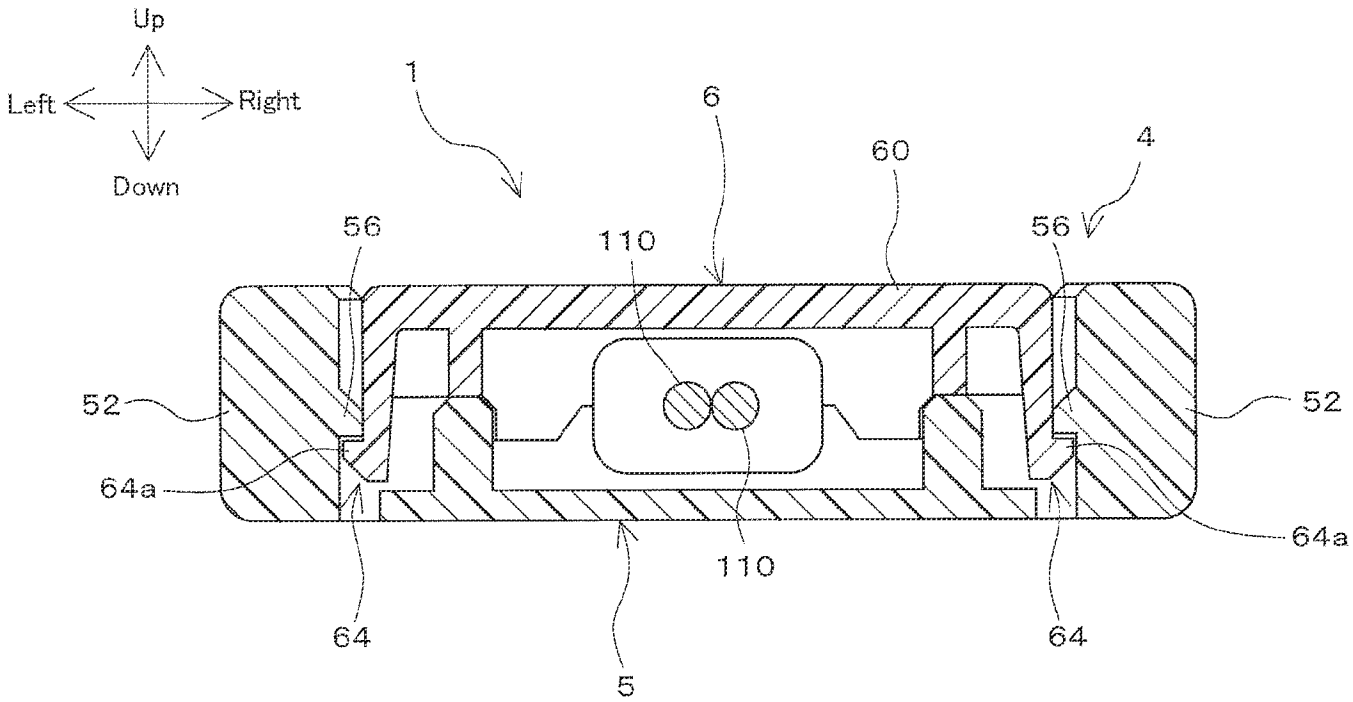
FIG. 11 is a cross-sectional view of the connector, and shows a cross-section at a position indicated by arrow lines B-B of FIG. 3.

FIGS. 7A to 7D are diagrams showing the body housing 5 of the housing 4, where FIG. 7A is a plan view, FIG. 7B is a front view, FIG. 7C is a right side view, and FIG. 7D is a bottom view. FIGS. 8A to 8D show the intermediate housing 6 of the housing 4, where FIG. 8A is a plan view. FIG. 8B is a front view. FIG. 8C is a right side view, and FIG. 8D is a bottom view. FIGS. 9A to 9D are diagrams showing the cover housing 7 of the housing 4, where FIG. 9A is a plan view, FIG. 9B is a front view, FIG. 9C is a right side view, and FIG. 9D is a bottom view. FIG. 10 is a cross-sectional view of the connector 1, and shows a cross-section at a position indicated by arrow lines A-A in FIG. 3. FIG. 11 is a cross-sectional view of the connector 1, and shows a cross-section at a position indicated by arrow lines B-B in FIG. 3.

As shown in FIGS. 1 to 3, 6, 7A to 7D, 10, and 11, the body housing 5 is provided as an element for holding the contacts 2 to which the wires 110 are connected. The body housing 5 is configured such that the intermediate housing 6, to which the cover housing 7 is attached, can be attached to the body housing 5. The body housing 5 has a bottom wall portion 50, a plurality of holding portions 51, and a pair of side wall portions 52.

The bottom wall portion 50 is formed in a rectangular shape and constitutes the bottom wall of the body housing 5. The bottom wall portion 50 is provided with a plurality of holding portions 51 on the upper surface side thereof, that is to say on one side in the thickness direction of the body housing 5.

The holding portions 51 are provided as portions for holding the contacts 2. The body housing 5 of the present embodiment is provided with a pair of holding portions 51 as the plurality of holding portions 51 in correspondence with the pair of contacts 2. The holding portions 51 are each formed in a groove-like recessed shape on the upper surface side of the bottom wall portion 50. The contacts 2 are respectively fitted into the groove-shaped recessed regions of the holding portions 51, and are thus held by the holding portions 51. Also, the holding portions 51 are each provided with a wall portion formed in a stepped manner on the front side, and are formed so as to be open on the rear side. The contacts 2 are held in the holding portions 51 in a state of being abutted against the wall portions on the front side. The wires 110 that are connected to the contacts 2 held by the holding portions 51 are arranged so as to extend out from the open region formed on the rear side.

Also, the holding portions 51 are provided in the body housing 5 so as to hold the contacts 2 at different height positions in the thickness direction of the body housing 5. The holding portions 51 are arranged in the body housing 5 so as to bring the electrically conductive portions 101 and the contacts 2 into contact with each other in the state where the portion of the electrically conductive member 100 is sandwiched between the cover housing 7 and the body housing 5.

Also, in the body housing 5 of the present embodiment, the first holding portion 51*a* and the second holding portion 51*b* are provided as the pair of holding portions 51 that constitute the plurality of holding portions 51. The first contact 20 is held by the first holding portion 51*a*, and the second contact 21 is held by the second holding portion 51*b*.

The first holding portion 51*a* that holds the first contact 20 and the second holding portion 51*b* that holds the second contact 21 are arranged at positions that are shifted from each other in the up-down direction (i.e., in the thickness direction of the body housing 5) and the front-rear direction in the body housing 5 in correspondence with the positions of contact with the electrically conductive portions 101 of the electrically conductive member 100. More specifically, as shown in FIG. 10, the first holding portion 51*a* is provided at a position where the height position thereof in the thickness direction of the body housing 5 is higher than that of the second holding portion 51*b* in the body housing 5. Accordingly, the first contact 20 held by the first holding portion 51*a* is arranged in the body housing 5 at a position where the height position in the thickness direction of the body housing 5 is higher than that of the second contact 21 held by the second holding portion 51*b*. Therefore, the first contact 20 and the second contact 21 are properly connected to the first electrically conductive portion 101*a* and the second electrically conductive portion 101*b* that are arranged at different height positions in the thickness direction of the electrically conductive member 100.

Also, as shown in FIGS. 6, 7A and 10, the first holding portion 51*a* is arranged forward of the second holding portion 51*b*. Accordingly, the first contact 20 held by the first holding portion 51*a* and the second contact 21 held by the second holding portion 51*b* are connected to the first electrically conductive portion 101*a* and the second electrically conductive portion 101*b* of the electrically conductive member 100 at positions that are shifted in the front-rear direction of the electrically conductive member 100.

The pair of side wall portions 52 of the body housing 5 are provided as wall portions that extend upward along the thickness direction of the body housing 5 from respective end portions in the left-right direction of the bottom wall portion 50 (i.e., the width direction of the body housing 5). The pair of side wall portions 52 each have a lid receiving portion 55, a first fixing piece receiving portion 56, and a second fixing piece receiving portion 57.

The lid receiving portions 55 are provided as portions for fixing the cover housing 7 to the body housing 5 at the closed position. Two lid receiving portions 55 are provided, and are respectively arranged on inward sides of the pair of side wall portions 52 in front side portions of the pair of side wall portions 52. The pair of lid receiving portions 55 are configured as portions that engage with a pair of later-described fastening portions 72 of the cover housing 7. Note that the pair of fastening portions 72 are configured to be inserted inward of the pair of side wall portions 52. The lid receiving portions 55 are formed as portions that protrude inward as projections on the side wall portions 52, and are configured to engage with the fastening portions 72 that have been inserted inward of the side wall portions 52. The fastening portions 72 that have been inserted inward of the side wall portions 52 engage with the lid receiving portions 55, and thus the fastening portions 72 are fixed to the lid receiving portions 55.

The first fixing piece receiving portions 56 are provided as portions for fixing the intermediate housing 6 to the body housing 5. The first fixing piece receiving portions 56 are configured as portions for engaging with a pair of later-described first fixing pieces 64 of the intermediate housing 6. Two first fixing piece receiving portions 56 are provided, and are respectively arranged on inward sides of the pair of side wall portions 52 in rear portions of the pair of side wall portions 52.

Similarly to the first fixing piece receiving portions 56, the second fixing piece receiving portions 57 are also provided as portions for fixing the intermediate housing 6 to the body housing 5. The second fixing piece receiving portions 57 are configured as portions that engage with a pair of later-described second fixing pieces 67 of the intermediate housing 6. Two second fixing piece receiving portions 57 are provided, and are respectively arranged in front side regions of regions inward of the pair of side wall portions 52. Also, in the present embodiment, the pair of second fixing piece receiving portions 57 are respectively provided on the two sides of a portion formed so as to partition the pair of holding portions 51 in the body housing 5.

As shown in FIGS. 1 to 3, 6, 8A to 8D, and 10, the intermediate housing 6 is configured as an element that is attached to the body housing 5 and prevents the contacts 2, which have been connected to the wires 110 and are held in the body housing 5, from coming out of the body housing 5. The intermediate housing 6 is also configured to prevent the contacts 2 from coming out of the body housing 5 in a state where the contact portions 31 of the spring contacts 29 of the contacts 2 are exposed.

The intermediate housing 6 is also configured to be attached to the body housing 5 in a state where the cover housing 7 is attached to the intermediate housing 6. The intermediate housing 6 is further configured to be engaged with and attached to the body housing 5 in a state of being fitted into the body housing 5 inward of the body housing 5 in the width direction. The intermediate housing 6 has an intermediate housing body portion 60, an inner lid portion 61, and a coupling portion 62.

The intermediate housing body portion 60 is provided as a portion on the rear side of the intermediate housing 6. The intermediate housing body portion 60 is configured to surround the upper side and the left and right sides of the end portions of the wires 110 that are connected to the contacts 2 and housed in the body housing 5. The intermediate housing body portion 60 is configured to engage with the body housing 5 in a state of being fitted into the body housing 5 in a portion on the rear side of the body housing 5. Also, the thickness of the intermediate housing 6 is set so as not to protrude from the body housing 5 in a state of being fitted in and attached to the body housing 5. Specifically, the height of the intermediate housing 6 in the up-down direction (thickness direction) is set such that the intermediate housing 6 does not protrude from the body housing 5 in the state where the intermediate housing 6 is fitted in the body housing 5.

Also, the intermediate housing body portion 60 is provided with a pair of support bearing grooves 63 and a pair of first fixing pieces 64. The pair of support bearing grooves 63 are provided as portions that rotatably support the cover housing 7. The pair of support bearing grooves 63 are formed with a receding shape, and are configured such that a later-described support shaft 73 of the cover housing 7 can be rotatably fitted therein. The pair of support bearing grooves 63 are provided at substantially central positions of the intermediate housing 6 in the front-rear direction.

The pair of first fixing pieces 64 are provided as portions for fixing the intermediate housing 6 to the body housing 5. The pair of first fixing pieces 64 are provided so as to extend downward from the two end portions in the left-right direction (width direction) of the intermediate housing body portion 60. The pair of first fixing pieces 64 each have an engaging protrusion 64*a*, and as shown in FIG. 11, the engaging protrusions 64*a* engage with the first fixing piece receiving portions 56 of the body housing 5. In this way, the intermediate housing 6 is attached to the body housing 5 by engagement of the pair of first fixing pieces 64 with the pair of first fixing piece receiving portions 56 of the body housing 5.

The inner lid portion 61 of the intermediate housing 6 is formed integrally with the intermediate housing body portion 60 via the coupling portion 62. The inner lid portion 61 is provided as a portion that extends substantially flatly. The inner lid portion 61 is provided so as to extend substantially flatly in the intermediate housing 6 such that the height position in the thickness direction of the intermediate housing 6 is different from that of the intermediate housing body portion 60. Also, the inner lid portion 61 is provided with a plurality of openings 65, a step portion 66, and a pair of second fixing pieces 67.

The openings 65 are formed as through holes that penetrate the inner lid portion 61 of the intermediate housing 6 in the up-down direction (i.e., the thickness direction of the intermediate housing 6). The openings 65 provided in the inner lid portion 61 are provided to respectively bring the contacts 2 into contact with the electrically conductive portions 101. The openings 65 are provided to allow the contact portions 31 of the contacts 2 to pass upward through the intermediate housing 6 in the thickness direction of the intermediate housing 6 in a state where the intermediate housing 6 is attached to the body housing 5. The inner lid portion 61 is provided so as to cover the contacts 2 around the openings 65 in a state where the intermediate housing 6 is attached to the body housing 5. In other words, the intermediate housing 6 is configured to be attached to the body housing 5 in a state where a portion of each of the contacts 2 held in the body housing 5 is covered by the inner lid portion 61.

In the inner lid portion 61, two openings 65 are provided in correspondence with the pair of contacts 2. More specifically, in the inner lid portion 61, a first opening 65*a* and a second opening 65*b* that are side-by-side in the left-right direction (i.e., the width direction of the intermediate housing 6) are provided as the pair of openings 65. The first opening 65*a* is provided in the right side region of the inner lid portion 61, and is formed as a substantially rectangular through hole. The second opening 65*b* is provided in the left side region of the inner lid portion 61, and is formed as a substantially rectangular through hole.

The step portion 66 is provided so as to correspond to any one of the plurality of contacts 2 held in the body housing 5 in a state where the intermediate housing 6 is attached to the body housing 5. In the present embodiment, as shown in FIGS. 2, 6, 8A to 8D, and 10, one step portion 66 is formed on the inner lid portion 61, and is provided so as to correspond to the first contact 20, which is one of the pair of contacts 2.

As shown in FIG. 10, the step portion 66 is formed in a stepped shape so as to be recessed on one surface side and raised on the other surface side in the thickness direction of the inner lid portion 61 of the intermediate housing 6. Also, the step portion 66 is provided with a first opening 65*a*, which is one of the pair of openings 65. The edge portion of the first opening 65*a* is formed so as to be recessed more than the peripheral portion of the step portion 66 of the inner lid portion 61 on the lower surface side, which is one surface side in the thickness direction, of the inner lid portion 61. Furthermore, the edge portion of the first opening 65*a* is formed so as to be raised more than the peripheral portion of the step portion 66 of the inner lid portion 61 on the upper surface side, which is the other surface side, of the inner lid portion 61.

According to the above configuration, regarding the height positions of the first opening 65*a* and the second opening 65*b* of the inner lid portion 61 in the up-down direction (i.e., the thickness direction of the intermediate housing 6), the height position of the first opening 65*a* is set higher than that of the second opening 65*b*. Also, the intermediate housing 6 is configured such that, when attached to the body housing 5, the intermediate housing 6 can more tightly cover the peripheral portions of the contact portions 31 of the first and second contacts (20, 21) in correspondence with the respective height positions of the first and second contacts (20, 21) that are held at different height positions in the thickness direction of the body housing 5.

The step portion 66 is set such that the protruding height thereof from the upper surface side of the inner lid portion 61 corresponds to the recess depth of the first recessed region 103*a* of the electrically conductive member 100 (see FIG. 10). Also, the outer size of the outer peripheral edge portion of the step portion 66 is set so as to be smaller than the outer size of the outer peripheral edge portion of the first recessed region 103*a* of the electrically conductive member 100. Accordingly, in this configuration, the step portion 66 is fitted in correspondence with the first recessed region 103*a* of the electrically conductive member 100 in a state where the end portion of the electrically conductive member 100 is sandwiched between the inner lid portion 61 of the intermediate housing 6 and the later-described cover housing 7.

Similarly to the pair of first fixing pieces 64 provided on the intermediate housing body portion 60, the pair of second fixing pieces 67 are provided as portions for fixing the intermediate housing 6 to the body housing 5. The pair of second fixing pieces 67 are provided so as to extend downward from the lower surface side of the inner lid portion 61 at positions inward of the two end portions in the left-right direction (width direction) of the inner lid portion 61. The pair of second fixing pieces 67 each have an engaging protrusion 67*a*, and as shown in FIG. 10, the engaging protrusions 67*a* engage with the second fixing piece receiving portions 57 of the body housing 5. In this way, the intermediate housing 6 is attached to the body housing 5 also by engagement of the pair of second fixing pieces 67 with the pair of second fixing piece receiving portions 57 of the body housing 5. In other words, the intermediate housing 6 is attached to the body housing 5 by engagement of the pair of first fixing pieces 64 with the pair of first fixing piece receiving portions 56, and also engagement of the pair of second fixing pieces 67 with the pair of second fixing piece receiving portions 57.

As shown in FIGS. 1 to 3, 6, 9A to 9D, 10, and 11, the cover housing 7 is provided as a portion for holding the electrically conductive member 100 in the housing 4 in a state where the electrically conductive portions 101 of the electrically conductive member 100 are in contact with the contacts 2. The cover housing 7 is configured to engage with and be attached to the body housing 5 in the state where the portion of the electrically conductive member 100 is sandwiched between the cover housing 7 and the body housing 5 via the intermediate housing 6. Also, the cover housing 7 is configured to engage with the body housing 5 in a state of being fitted into the body housing 5 inward of the body housing 5 in the width direction.

Also, the cover housing 7 is rotatably coupled to the intermediate housing 6. More specifically, the cover housing 7 is provided such that one end side thereof is coupled to an intermediate position in the front-rear direction of the intermediate housing 6. The cover housing 7 is rotatably coupled to the intermediate housing 6 such that the upper surface side portion of the inner lid portion 61 can be opened and closed with respect to the outside. Accordingly, the cover housing 7 is configured to be rotated between an open position relative to the intermediate housing 6 in which the upper surface side of the inner lid portion 61 is open, and a closed position relative to the intermediate housing 6 in which the upper surface side of the inner lid portion 61 is closed. The electrically conductive member 100 is connected to the connector 1 by rotating the cover housing 7 relative to the intermediate housing 6. Also, the cover housing 7 is configured such that, when at the closed position relative to the intermediate housing 6, an end portion of the electrically conductive member 100, which is a portion of the sheet-like electrically conductive member 100, is sandwiched between the cover housing 7 and the inner lid portion 61 of the intermediate housing 6.

Also, the cover housing 7 has a lid portion 70, a pair of support walls 71, and a pair of fastening portions 72. The lid portion 70 is provided as a portion that extends flatly. The lid portion 70 is provided as a portion for sandwiching and fixing the end portion of the electrically conductive member 100 together with the lid portion 61 of the intermediate housing 6.

The pair of support walls 71 are configured as portions that rotatably couple the cover housing 7 to the intermediate housing 6. The pair of support walls 71 are provided on the rear end side of the lid portion 70, and extend downward from the two end portions of the lid portion 70 in the left-right direction (the width direction of the cover housing 70). The pair of support walls 71 each have a support shaft 73.

The support shafts 73 are provided as portions that are rotatably supported by the support bearing groove 63 of the intermediate housing 6. As shown in FIGS. 9A and 9D, the support shafts 73 are formed as portions that extend in a columnar shape. The pair of support shafts 73 provided on the pair of support walls 71 extend in a cantilevered manner toward each other from the inner surfaces of the pair of support walls 71. The cover housing 7 is rotatably coupled to the intermediate housing 6 due to the pair of support shafts 73 being fitted into and rotatably supported by the pair of support bearing grooves 63.

The pair of fastening portions 72 are provided as portions for engaging the cover housing 7, which is rotatably coupled to the intermediate housing 6, with the body housing 5 in the state where the cover housing 7 is at the closed position relative to the intermediate housing 6. The pair of fastening portions 72 are configured to fix and lock the position of the cover housing 7 relative to the body housing 5 by engaging the cover housing 7 with the body housing 5.

More specifically, the pair of fastening portions 72 are provided as portions that are engaged with and fixed to the pair of lid receiving portions 55 of the body housing 5. The pair of fastening portions 72 are provided so as to respectively extend downward from the two end portions of the lid portion 70 in the width direction. Furthermore, the pair of fastening portions 72 each have an engaging protrusion 72*a* that protrudes outward in the width direction of the cover housing 7, as shown in FIGS. 1, 2, 6, 9A to 9D, and 10. The fastening portions 72 are engaged with and fixed to the lid receiving portions 55 due to the engaging protrusions 72*a* engaging with the lid receiving portions 55 in a state of being inserted inward of the side wall portions 52.

Connector Connection Operation

The following describes a connection operation of the above-described connector 1 for connecting the electrically conductive member 100 and the wires 110. In the connection operation of the connector 1, first, the wires 110 are electrically and mechanically connected to the contacts 2 by being crimped to the crimp portions 23. Then, the contacts 2 that have been connected to the wires 110 are fitted into the holding portions 51 so as to be held in the body housing 5. Accordingly, the contacts 2 are held in the body housing 5 at different height positions in the thickness direction of the body housing 5.

When the contacts 2 connected to the wire 110 have been held in the body housing 5, the cover housing 7 is rotatably coupled to the intermediate housing 6. Specifically, the cover housing 7 is rotatably coupled to the intermediate housing 6 by fitting the pair of support shafts 73 of the cover housing 7 into the pair of support bearing grooves 63 of the intermediate housing 6.

When the cover housing 7 has been coupled to the intermediate housing 6, the intermediate housing 6 coupled to the cover housing 7 is attached to the body housing 5. At this time, the first fixing pieces 64 of the intermediate housing 6 engage with the first fixing piece receiving portions 56 of the body housing 5, and the second fixing pieces 67 of the intermediate housing 6 engage with the second fixing piece receiving portions 57 of the body housing 5, and thus the intermediate housing 6 is attached to the body housing 5. Also, in this state, the peripheral portions of the contact portions 31 of the contacts 2 held in the body housing 5 are covered by the intermediate housing 6. Also, the apex portions of the contact portions 31 of the contacts 2 protrude from the openings 65 of the intermediate housing 6. Specifically in the inner lid portion 61 of the intermediate housing 6, the apex portion of the contact portion 31 of the first contact 20 protrudes from the first opening 65*a*, and the apex portion of the contact portion 31 of the second contact 21 protrudes from the second opening 65*b*.

When the intermediate housing 6 has been attached to the body housing 5, the electrically conductive member 100 is then connected to the connector 1. At this time, first, the cover housing 7, which is rotatably coupled to the intermediate housing 6 that is fixed to the body housing 5, is rotated to the open position relative to the intermediate housing 6 (the state shown in FIG. 2). In this open position state, the end portion of the electrically conductive member 100 is arranged on the upper surface side of the inner lid portion 61 of the intermediate housing 6. Note that at this time, the end portion of the electrically conductive member 100 is arranged on the upper surface side of the inner lid portion 61 in a state where the surface 100*b*, at which the recessed region 103 is open, faces the upper surface of the inner lid portion 61.

Due to the end portion of the electrically conductive member 100 being arranged on the upper surface side of the inner lid portion 61 as described above, the first electrically conductive portion 101*a* exposed at the bottom portion of the first recessed region 103*a* of the electrically conductive member 100 is in a state of being in contact with the contact portion 31 of the first contact 20. Also, the second electrically conductive portion 101*b* exposed at the surface 100*b* of the electrically conductive member 100 is in a state of being in contact with the contact portion 31 of the second contact 21.

In the state where the end portion of the electrically conductive member 100 is arranged on the upper surface side of the inner lid portion 61 as described above, the cover housing 7 is then rotated relative to the intermediate housing 6 until the cover housing 7 is at the closed position relative to the intermediate housing 6 (the state shown in FIG. 1). When the cover housing 7 is at the closed position relative to the intermediate housing 6, the pair of fastening portions 72 of the cover housing 7 are engaged with and fixed to the pair of lid receiving portions 55 of the body housing 5. Accordingly, the cover housing 7 engages with the body housing 5 in the state where the portion of the electrically conductive member 100 is sandwiched by the cover housing 7 as well as the body housing 5 and the intermediate housing 6. In other words, the cover housing 7 engages with the body housing 5 in the state where the portion of the electrically conductive member 100 is sandwiched between the cover housing 7 and the body housing 5 via the intermediate housing 6. Accordingly, the cover housing 7 is locked at a fixed position relative to the body housing 5. Then, in the state where the end portion of the electrically conductive member 100 is sandwiched by the cover housing 7 as well as the body housing 5 and the intermediate housing 6, the first contact 20 is in contact with the first electrically conductive portion 101*a* and the second contact 21 is in contact with the second electrically conductive portion 101*b* of the second contact 21, and this state is maintained. Accordingly, the connection operation of the connector 1 for connecting the electrically conductive member 100 and the wires 110 is complete.

Note that upon being connected to the connector 1 as described above, the electrically conductive member 100 provided as the sheet sensor 100 for liquid leak detection is then arranged in various areas where there is a requirement to detect the presence or absence of the leakage of a conductive liquid such as water. As previously described, if a liquid leak occurs in the area where the electrically conductive member 100 is arranged, the first electrically conductive portion 101*a* and the second electrically conductive portion 101*b* come into electrical conduction with each other, and the liquid leak detector connected to the pair of wires 110 detects that a liquid leak has occurred.

Actions and Effects of the Embodiment

According to the present embodiment, the plurality of contacts 2 connected to the wires 110 are held by the plurality of holding portions 51 of the body housing 5, and the holding portions 51 hold the contacts 2 at different height positions in the thickness direction of the body housing 5. The cover housing 7 is engaged with and attached to the body housing 5 in the state where the portion of the electrically conductive member 100 is sandwiched between the body housing 5 and the cover housing 7, and the electrically conductive portions 101 and the contacts 2 come into contact with each other. For this reason, the electrically conductive portions 101 arranged at different height positions in the thickness direction of the sheet-like electrically conductive member 100 and the contacts 2 held at different height positions in the thickness direction of the body housing 5 are easily and properly connected at corresponding height positions.

Therefore, according to the present embodiment, it is possible to provide the connector 1 that can be easily and properly connected to the sheet-like electrically conductive member 100 that is provided with the plurality of electrically conductive portions 101 that are arranged at different height positions in the thickness direction.

Also, according to the present embodiment, the intermediate housing 6 is attached to the body housing 5 in a state of covering a portion of each of the contacts 2 held in the body housing 5, and therefore the contacts 2 can be firmly held in a more stable state. Also, the intermediate housing 6 is provided with the plurality of openings 65, and therefore the contacts 2 and the electrically conductive portions 101 can be easily brought into contact with each other with a simple structure.

Also, according to the present embodiment, the intermediate housing 6 is provided with the step portion 66 at a position corresponding to one of the contacts 2, the step portion 66 being recessed on one surface side in the thickness direction and raised on the other surface side and being provided with the opening 65. For this reason, the intermediate housing 6 has a structure for more tightly covering portions of the contacts 2 in correspondence with the respective height positions of the contacts 2 that are held at different height positions in the thickness direction in the body housing 5, and this intermediate housing 6 can be easily realized with a simple structure. Also, the intermediate housing 6 is provided with the raised portion at a position corresponding to one of the contacts 2, and therefore a longer insulation distance can be ensured between the contacts 2, and higher connection stability can be obtained due to ensuring the insulation distance.

Also, according to the present embodiment, the cover housing 7, which is rotatably coupled to the intermediate housing 6, sandwiches the portion of the electrically conductive member 100 together with the body housing 5 and the intermediate housing 6. In other words, the cover housing 7 rotatably coupled to the intermediate housing 6 sandwiches the portion of the electrically conductive member 100 with the body housing 5 via the intermediate housing 6. Also, the cover housing 7 is locked by being engaged with the body housing 5 in the state where the portion of the electrically conductive member 100 is sandwiched by the cover housing 7 together with the body housing 5 and the intermediate housing 6. For this reason, in the operation of connecting the connector 1 and the sheet-like electrically conductive member 100, the operator can easily connect connector 1 and the electrically conductive member 100 by merely rotating the cover housing 7 in a state where a portion of the electrically conductive member 100 is arranged on the body housing 5 and the intermediate housing 6. Also, because the cover housing 7 that is rotatably coupled to the intermediate housing 6 is engaged with and locked to the body housing 5, the electrically conductive member 100 that is sandwiched by the cover housing 7 as well as the body housing 5 and the intermediate housing 6 can be held more firmly and stably. Accordingly, even if the connector 1 is used in an environment that is likely to be subjected to vibration or the like from the outside, it is possible to maintain the state in which the sheet-like electrically conductive member 100 is firmly held by the connector 1.

Also, according to the present embodiment, the cover housing 7 is engaged with the body housing 5 in a state of being fitted inward thereof in the width direction. For this reason, even if an external object comes into contact with the connector 1, it is possible to prevent the object from becoming caught on and coming into contact with the cover housing 7. Accordingly, even if an external force acts on the connector 1, it is possible to suppress the case where the cover housing 7 is subjected to force in a direction for causing the cover housing 7 to detach from the body housing 5. Accordingly, even if the connector 1 is used in an environment that is likely to be subjected to vibration or the like from the outside, it is possible to further stably maintain the state in which the sheet-like electrically conductive member 100 is firmly held by the connector 1.

Also, according to the present embodiment, the sheet-like electrically conductive member 100 to which the connector 1 is connected is configured as a sheet sensor 100 for liquid leak detection. In a state where a portion of the sheet sensor 100 is sandwiched between the cover housing 7 and the body housing 5, the first contact 20 of the connector 1 comes into contact with the first electrically conductive portion 101*a* that extends at a position corresponding to the bottom portion of the recessed region 103 of the sheet sensor 100, and the second contact 21 of the connector 1 comes into contact with the second electrically conductive portion 101*b* that extends on the surface 100*b* of the sheet sensor 100. For this reason, the first and second electrically conductive portions 101*a* and 101*b* that are arranged at different height positions in the thickness direction in the sheet sensor 100 and the first and the second contacts 20 and 21 that are held at different height positions in the thickness direction in the body housing 5 can be easily and properly connected at corresponding height positions. Therefore, according to the present embodiment, it is possible to provide the connector 1 that can be easily and properly connected to the sheet sensor 100 for liquid leak detection that is provided with the plurality of electrically conductive portions 101 arranged at different height positions in the thickness direction.

Variations

Although an embodiment of the present invention has been described above, the present invention is not limited to the above-described embodiment, and various modifications can be made within the description of the claims. For example, changes such as the following may be made.

(1) In the embodiment described above, an aspect is described in which the housing includes the body housing, the intermediate housing, and the cover housing, but the present invention is not limited to this. An aspect is possible in which the housing includes only the body housing and the cover housing, and does not include the intermediate housing.

(2) In the embodiment described above, an aspect is described in which the connector has a pair of contacts as the plurality of contacts, but the present invention is not limited to this. An aspect is possible in which the connector includes three or more contacts.

(3) In the embodiment described above, an aspect is described in which the sheet sensor for liquid leak detection serves as the sheet-like electrically conductive member to which the connector is connected, but the present invention is not limited to this. The sheet-like electrically conductive member to which the connector is connected need only be an electrically conductive member that is provided with a plurality of electrically conductive portions arranged at different height positions in the thickness direction. For example, the connector may be configured to be connected to an electrically conductive member that is a sheet-like electrically conductive member configured as a flexible circuit board, a flexible flat cable, or the like, and that is provided with a plurality of electrically conductive portions arranged at different height positions in the thickness direction of the electrically conductive member.

(4) In the embodiment described above, an aspect is described in which one step portion is provided in the intermediate housing, but the present invention is not limited to this. For example, an aspect is possible in which the connector includes an intermediate housing that is provided with a plurality of step portions.

(5) Although the connector 1 for connection to the electrically conductive member 100 has been described in the above embodiment, the invention may be implemented as a harness unit that includes the electrically conductive member 100 and the connector 1 for connection to the electrically conductive member 100. For example, the invention may be implemented as a harness unit for liquid leak detection that includes the electrically conductive member 100 configured as the sheet sensor 100 for liquid leak detection and the connector 1 that is connected to the electrically conductive member 100.

INDUSTRIAL APPLICABILITY

The present invention is broadly applicable as a connector for connection to an electrically conductive member that is a sheet-like electrically conductive member and is provided with a plurality of electrically conductive portions that are arranged at different height positions in the thickness direction of the electrically conductive member.

LIST OF REFERENCE NUMERALS

1 Connector
2 Contact
5 Body housing
6 Intermediate housing
7 Cover housing
51 Holding portion 51
100 Electrically conductive member
101 Electrically conductive portion

The invention claimed is:

1. A connector for connection to an electrically conductive member that is a sheet-like electrically conductive member and is provided with a plurality of electrically conductive portions that are arranged at different height positions in a thickness direction of the electrically conductive member, the connector comprising:

a plurality of contacts;

a body housing configured to hold the plurality of contacts; and a cover housing configured to be engaged with and attached to the body housing in a state where a portion of the electrically conductive member is sandwiched between the cover housing and the body housing, wherein the body housing includes a plurality of holding portions configured to respectively hold the plurality of contacts, the plurality of holding portions are provided in the body housing so as to respectively hold the plurality of contacts at different height positions in a thickness direction of the body housing, and the plurality of electrically conductive portions and the plurality of contacts are respectively in contact with each other in the state where the portion of the electrically conductive member is sandwiched between the cover housing and the body housing, and wherein the connector further comprises:

an intermediate housing that is configured to be attached to the body housing in a state of covering a portion of each of the plurality of contacts held in the body housing, and is provided with a plurality of openings for allowin the plurality of contacts to respectively come into contact with the plurality of electrically conductive portions.

2. The connector according to claim 1, wherein the intermediate housing is provided with a step portion formed in a stepped shape so as to be recessed on one surface side and raised on another surface side in a thickness direction of the intermediate housing, an opening among the plurality of openings is provided in the step portion, and the step portion is provided at a location corresponding to any one of the plurality of contacts held in the body housing in a state where the intermediate housing is attached to the body housing.

3. The connector according to claim 1, wherein the cover housing is configured so as to be ro atably coupled to the intermediate housing, and a position of the cover housing is locked relative to the body housing due to the cover housing engaging with the body housing in the state where the portion of the electrically conductive member is sandwiched by the cover housing together with the body housing and the intermediate housing.

4. The connector according to claim 3, wherein the cover housing is configured to be engaged with the body housing in a state where the cover housing is fitted into the body housing inward of the body housing in the width di rection.

5. A connector for connection to an electrically conductive member that is a sheet-like electrically conductive member and is provided with a plurality of electrically conductive portions that are arranged at different height positions in a thickness direction of the electrically conductive member, the connector comprising:

a plurality of contacts;

a body housing configured to hold the plurality of contacts; and a cover housing configured to be engaged with and attached to the body housing in a state where a portion of the electrically conductive member is sandwiched between the cover housing and the body housing, wherein the body housing includes a plurality of holding portions configured to respectively hold the plurality of contacts, the plurality of holding portions are provided in the body housing so as to respectively hold the plurality of contacts at different height positions in a thickness direction of the body housing, and the plurality of electrically conductive portions and the plurality of contacts are respectively in contact with each other in the state where the portion of the electrically conductive member is sandwiched between the cover housing and the body housing, and wherein the electrically conductive member is a sheet sensor for liquid leak detection, the electrically conductive member includes a first electrically conductive portion and a second electrically conductive portion that are arranged at different height positions in the thickness direction of the electrically conductive member, as the plurality of electrically conductive portions, the first electrically conductive portion is arranged so as to extend in a layer at a position corresponding to a bottom portion of a recessed region that is a region of the electrically conductive member that is recessed in the thickness direction of the electrically conductive member, the second electrically conductive portion is arranged so as to extend in a layer along a surface of the electrically conductive member in a region surrounding the recessed region, a first contact and a second contact that are held in the body housing at different height positions in the thickness direction of the body housing are provided as the plurality of contacts, and in the state where the portion of the electrically conductive member is sandwiched between the cover housing and the body housing, the first contact is in contact with the first electrically conductive portion, and the second contact is in contact with the second electrically conductive portion.

* * * * *